US007350946B2

(12) United States Patent
Yagi et al.

(10) Patent No.: US 7,350,946 B2
(45) Date of Patent: Apr. 1, 2008

(54) VEHICLE HEADLAMP

(75) Inventors: Takayuki Yagi, Shizuoka (JP); Naoki Uchida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 126 days.

(21) Appl. No.: 11/221,936

(22) Filed: Sep. 9, 2005

(65) Prior Publication Data

US 2006/0056192 A1 Mar. 16, 2006

(30) Foreign Application Priority Data

Sep. 10, 2004 (JP) ..... P.2004-264036

(51) Int. Cl.
*F21V 7/00* (2006.01)

(52) U.S. Cl. ..... 362/517; 362/465; 362/512; 362/516; 362/538

(58) Field of Classification Search ..... 362/335, 362/465, 512, 516, 517, 538, 539
See application file for complete search history.

(56) References Cited

U.S. PATENT DOCUMENTS 1,655,559 A * 1/1928 Neary ..... 362/284
2004/0022067 A1* 2/2004 Taniuchi ..... 362/517
2004/0027836 A1* 2/2004 Takada et al. ..... 362/539
2004/0228139 A1* 11/2004 Taniuchi ..... 362/539

FOREIGN PATENT DOCUMENTS

| | | |
|---|---|---|
| DE | 103 09 181 A1 | 10/2003 |
| EP | 0 561 410 A1 | 9/1993 |
| JP | 2003-257218 A | 9/2003 |

* cited by examiner

*Primary Examiner*—Sandra O'Shea
*Assistant Examiner*—Mary Zettl
(74) *Attorney, Agent, or Firm*—Sughrue Mion, PLLC

(57) ABSTRACT

A light-gathering reflection surface is provided on a part of a reflection area on a reflection surface of the reflector. Light from the light source reflected onto the light-gathering surface is emitted as light substantially parallel to an optical axis from the projection lens in the front direction of a lighting fixture. Thus, an irradiation amount on a vicinity of a horizontal cutoff line is reduced, and a center intensity in a front direction in a high beam light distribution pattern is enhanced.

5 Claims, 8 Drawing Sheets

VEHICLE HEADLAMP

The present application claims foreign priority based on Japanese Patent Application No. P.2004-264036, filed on Sep. 10, 2004, the contents of which are incorporated herein by reference.

BACKGROUND OF THE INVENTION

1. Field of the Invention

The present invention relates to a projector-type vehicle headlamp, and in particular to a vehicle headlamp having a movable shade.

2. Related Art

There is a projector-type vehicle headlamp having a projection lens arranged on an optical axis extending in a longitudinal direction of a vehicle and a light source arranged behind a rear focus of a projection lens. The projector-type vehicle headlamp is designed to reflect light from the light source onto an area close to the optical axis. When a low beam light distribution pattern is formed, a shade arranged so as to position its top end edge near the optical axis in a vicinity of the rear focus of the projection lens is used to shield a part of a reflected light from a reflector to form a predetermined cutoff line at a top end of a low beam light distribution pattern.

Disclosed in JP-A-2003-257218 is a projector-type vehicle headlamp having a movable shade designed to move between a light shielding position where a top end edge of a shade is positioned near an optical axis in a vicinity of a rear focus of a projection lens and a light shielding alleviating position where a shading amount for reflected light from a reflector is reduced than the light shielding position.

The vehicle headlamp described in JP-A-2003-257218 can form a high beam light distribution pattern by moving the movable shade to the light shielding alleviating position. Therefore, a single lighting fixture unit can be used for a low beam and a high beam.

According to the project-type vehicle headlamp, when a low beam light distribution pattern is formed, a crisp cutoff line can be formed at a top end of the low beam light distribution pattern. However, this provides a light distribution pattern that has a high intensity up to a neighborhood of the cutoff line. As a result, when the vehicle is pitching, a glare is caused to the drivers of oncoming vehicles.

SUMMARY OF THE INVENTION

One or more embodiments of the present invention provide a projector-type vehicle headlamp equipped with a movable shade that prevents a glare to the drivers of oncoming vehicles even when the vehicle pitches while traveling under low-beam illumination conditions as well as improving the long distance visibility under high-beam illumination conditions.

In accordance with one or more embodiments of the present invention, a vehicle headlamp is provided with: a projection lens arranged on an optical axis extending in a longitudinal direction of a vehicle; a light source arranged behind a rear focus of the projection lens; a reflector for reflecting light from the light source in forward direction close to the optical axis; a movable shade movable to shield part of the reflected light from the reflector; an actuator that moves the movable shade between a light shielding position and a light shielding alleviating position, wherein a low beam light distribution pattern having a horizontal cutoff line is formed when the movable shade is in the light shielding position, and a high beam light distribution pattern is formed when the movable shade is in the light shielding alleviating position; and a light-gathering reflection surface for reflecting light from the light source toward the vicinity of the projection lens provided on a part of a reflection area of the reflector contributing to the formation of the horizontal cutoff line.

In accordance with one or more embodiments of the present invention, when the movable shade is in the light shielding position a top end edge of the shade is positioned near the optical axis in a vicinity of the rear focus of a projection lens, and when the movable shade is in the light shielding alleviating position, a shading amount for reflected light from a reflector is reduced than the light shielding position.

In accordance with one or more embodiments of the present invention, the horizontal cutoff line is formed on an oncoming lane side section in the low beam light distribution pattern.

In accordance with one or more embodiments of the present invention, the light-gathering reflection surface is formed in a vicinity of a rear top of the reflector.

In accordance with one or more embodiments of the present invention, an opening is formed at a rear top of the reflector, and the light-gathering reflection surface is formed in the vicinity of the opening.

Moreover, in accordance with one or more embodiments of the present invention, a reflector of a vehicle headlamp is provided with: a first reflection surface, wherein a cross section thereof through an optical axis of the vehicle headlamp comprises a substantially elliptical shape having a first focus on a center position of a light source; and a second reflection surface comprising a spheroidal surface having a center axis on the optical axis, a first focus on the center position of the light source, and a second focus on a rear focus of a projection lens.

In accordance with one or more embodiments of the present invention, the second reflection surface comprises substantially rectangular shape.

In accordance with one or more embodiments of the present invention, an eccentricity of the first reflection surface gradually increases from a vertical crosssection to a horizontal cross section.

The type of the "light source" is not particularly limited. For example, a discharge light-emitter of a discharge bulb, or a filament of a halogen lamp may be used.

Specific configuration of the "movable shade" such as its profile and size are not particularly limited. The form of movement of the "movable shade" is not limited either. For example, rotational or linear movement can be used. While the movable shade is designed to shield part of the reflected light from a reflector, it may completely or partially release shielding of the reflected light from the reflector in the light shielding alleviating position as long as it shields part of the reflected light from the reflector when it is in the light shielding position.

The specific configuration of the "actuator" is not particularly limited as long it is designed to move the movable shade between the light shielding position and light shielding alleviating position. For example, a solenoid or a pulse motor can be used.

The cutoff line profile of the "cutoff line" on the own lane side section is not particularly limited as long as the oncoming lane side section is configured as a horizontal cutoff line. The "oncoming lane side section" means a section positioned on the oncoming lane side of a vanishing point in the front direction of a lighting fixture unit.

The light-gathering reflection surface is a part of a reflection area contributing to formation of a horizontal cutoff line. Its specific position, reflection surface profile or size is not particularly limited.

As shown in the above configuration, the vehicle headlamp according to one or more embodiments of the present invention is configured as a projector-type vehicle headlamp equipped with a movable shade and is designed to form, when the movable shade is in the light shielding position, a low beam light distribution pattern having a cutoff line where the oncoming lane side section is formed as a horizontal cutoff line. In this practice, a reflection area of the reflection surface of a reflector contributing to formation of the horizontal cutoff line is partially configured as a light-gathering reflection surface reflecting light from a light source toward the vicinity of the rear focus of a projection lens. This provides the following operation/working-effect.

The light from a light source reflected onto a reflector goes toward the vicinity of the rear focus of the projection lens, so that the light is emitted from the projection lens as light substantially parallel to an optical axis in the front direction of a lighting fixture. This reduces the irradiation amount on the vicinity of the horizontal cutoff line in the oncoming lane side section in the low beam light distribution pattern. Thus, there is no fear of glare to the drivers of oncoming vehicles even when the vehicle pitches while traveling under low-beam illumination conditions. Moreover, it is possible to enhance the center intensity in the front direction of the lighting fixture unit in the high beam light distribution pattern.

With the projector-type vehicle headlamp equipped with a movable shade according to one or more embodiments of the present invention, it is possible to prevent glare to the drivers of oncoming vehicles even when the vehicle pitches while traveling under low-beam illumination conditions, as well as improving the long distance visibility under high-beam illumination conditions.

While the specific position of the light-gathering surface is not particularly limited as mentioned above, forming the light-gathering surface in the vicinity of the top of the reflector will give the following operation/working-effect.

The region in the vicinity of the rear top of the reflector in the reflection area contributing to formation of a horizontal cutoff line positioned in the oncoming lane side section is suitable for forming the portion relatively close to the vanishing point in the forward direction of the lighting fixture unit in the horizontal cutoff line. The reflected light from the region in the vicinity of the rear top of the reflector is a main cause of glare to the drivers of oncoming vehicles caused by pitching of the vehicle. Forming a light-gathering reflection surface in the vicinity of the rear top of the reflector more effectively suppresses glare to the drivers of oncoming vehicles.

Many vehicle headlamps equipped with movable shades each has an opening for inserting a light source bulb formed at the rear top of the reflector. The light-gathering reflection surface is formed in the vicinity of the opening. This more effectively suppresses glare to the drivers of oncoming vehicles.

Other aspects and advantages of the invention will be apparent from the following description and the appended claims.

DESCRIPTION OF THE PREFERRED EMBODIMENTS

Embodiments of the invention will be described with reference to the accompanying drawings.

Figure 1:
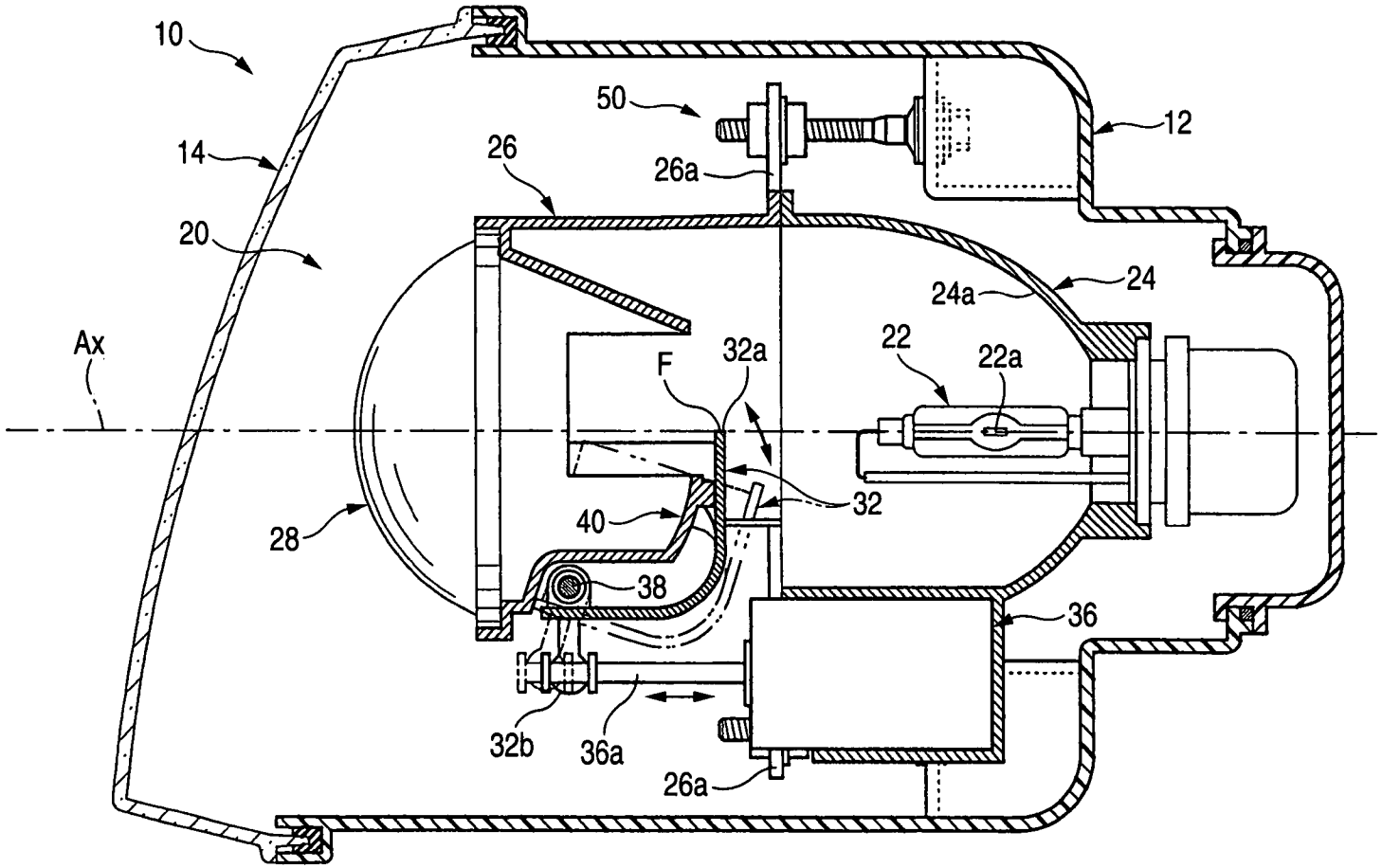
FIG. 1 is a side cross sectional view of a vehicle headlamp according to an embodiment of the invention.

FIG. 1 shows a side cross section of a vehicle headlamp 10 according to an embodiment of the present invention.

As shown in FIG. 1, the vehicle headlamp 1 comprises a lamp room formed by a lamp body and a see-through translucent cover 14 attached to the front end opening thereof, the lamp room accommodating a lighting fixture unit 20 having an optical axis Ax extending in the longitudinal direction of a vehicle via an aiming mechanism 50 in a tiltable fashion in vertical and horizontal directions.

Once aiming adjustment is made by the aiming mechanism 50, the optical axis Ax of the lighting fixture unit 20 of the vehicle headlamp 10 extends in a direction 0.5 to 0.6 degrees downward with respect to the longitudinal direction of the vehicle.

Figure 2:
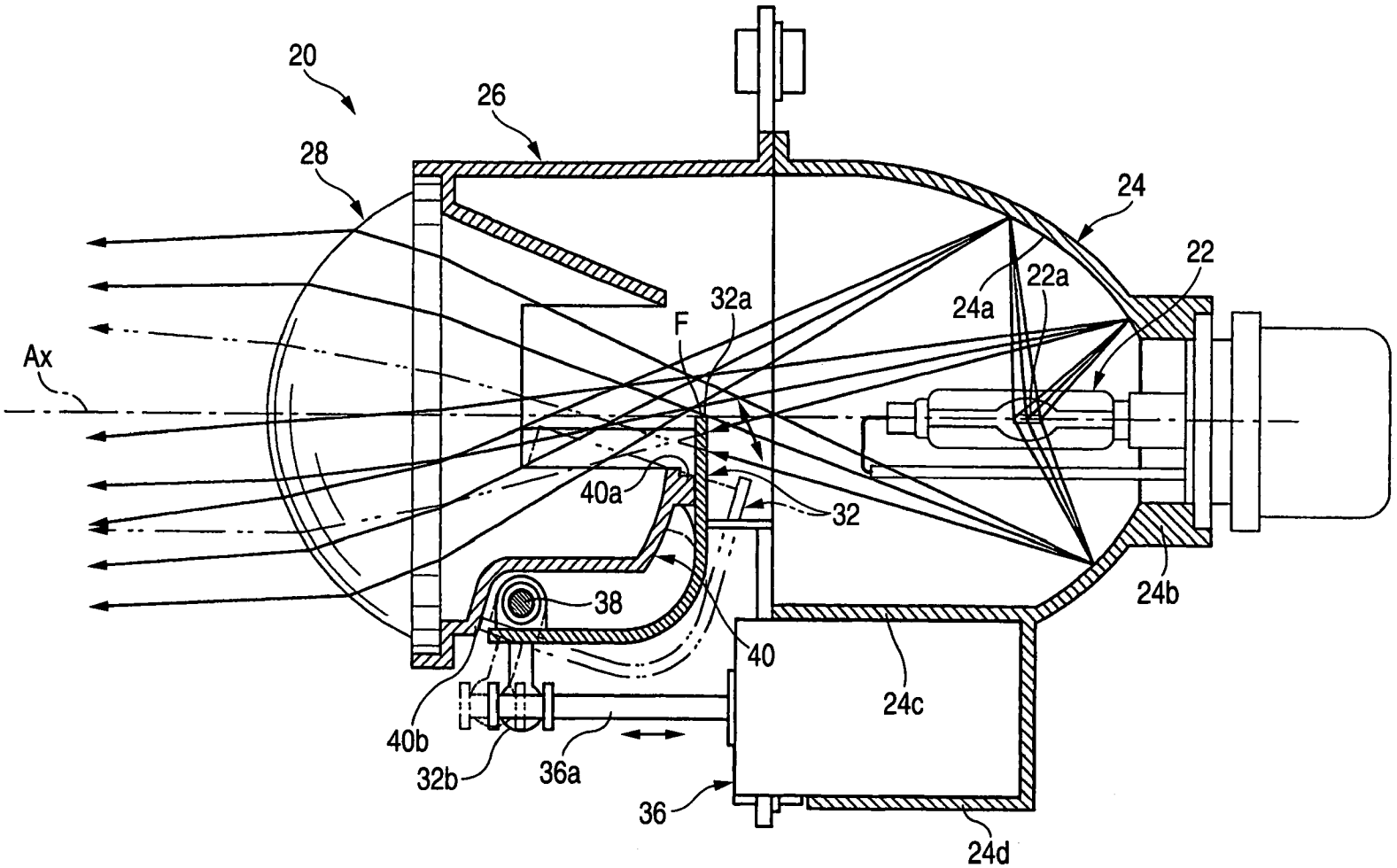
FIG. 2 is a side cross sectional view of a lighting fixture unit of the vehicle headlamp as a standalone unit.
Figure 3:
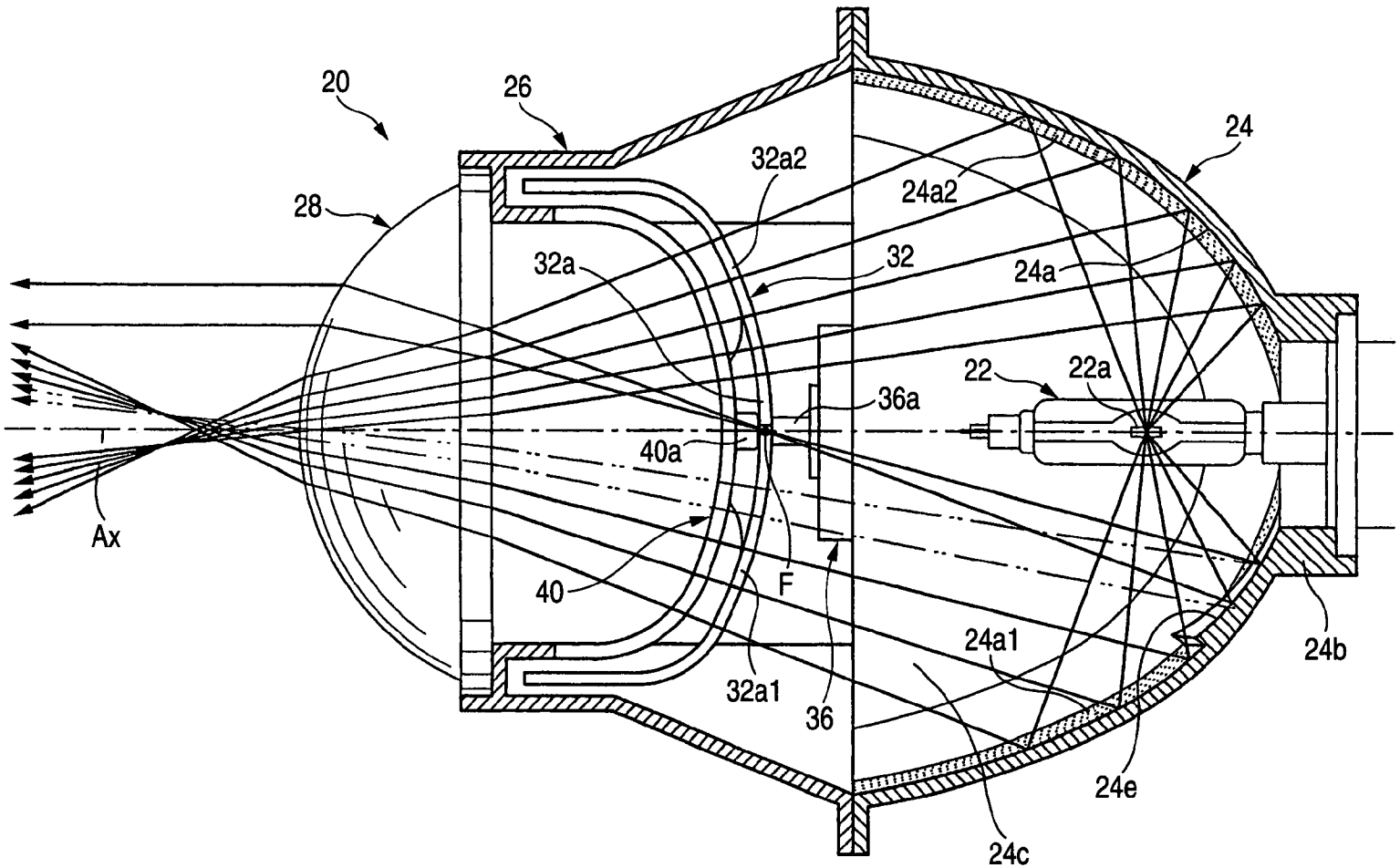
FIG. 3 is a horizontal cross sectional view of the lighting fixture unit.

FIGS. 2 and 3 show a side cross section and a horizontal cross section of the lighting fixture unit 20 as a standalone unit, respectively.

As shown in FIGS. 2 and 3, the lighting fixture unit 20 is a projector-type lighting fixture unit and comprises a light source bulb 22, a reflector 24, a holder 26, a projection lens 28, a movable shade 32, and an actuator 36.

The projection lens 28 configured as a plano-convex lens whose front surface is a convex curved surface and whose rear surface is a plane is arranged on the optical axis Ax. The projection lens 28 is designed to project in forward direction an image on a focal plane including the rear focus of the projection lens 28 as an inverted image.

The light source bulb 22 is a discharge bulb such as a metal halide bulb whose discharge emitter is a light source 22*a*. The light bulb 22 is inserted and fixed from behind to the opening formed in the rear top of the reflector 24*b* of the reflector 24. The light source 22*a* of the light source bulb 22 is positioned behind the rear focus F of the projection lens 28.

The reflector 24 has a reflection surface 24*a* that reflects light from the light source 22*a* in forward direction toward an area close to the optical axis Ax. The reflection surface 24*a* (a first reflection surface 24*a*) is designed so that its substantially elliptical cross section through the optical axis Ax has a first focus as the center position of the light source 22*a* on the optical axis Ax and its eccentricity gradually increases from the vertical cross section to the horizontal cross section. Thus, the light from the light source 22*a* reflected onto the reflection surface 24*a* is substantially converged in the vicinity of the rear focus F in the vertical cross section while the convergence position of the light is shifted substantially forward in the horizontal cross section.

The holder 26 is formed so as to extend forward, in the profile of a substantial cylinder, from the front end opening of the reflector 24. The holder 26 fixedly supports the reflector 24 at its rear end and fixedly supports the projection lens 28 at its front end. The holder has a notched lower area and its rear end periphery has a plurality of aiming brackets 26*a* formed for coupling the lighting fixture unit 20 to the aiming mechanism 50.

The movable shade 32 is provided so as to be positioned in an approximate lower section of the internal space of the holder 26. The lower end of the shade 32 is rotatably supported by the holder 26 via a rotating pin 38 extending in lateral direction. The movable shade may take a light shielding position shown by solid lines in FIG. 2 and a light shielding alleviating position rotated by a predetermined angle rearward from the light shielding position shown by chain double-dashed lines in FIG. 2. The top end edge 32*a* of the movable shade 32 has a stepped difference in lateral direction and extends along the rear focal plane of the projection lens 28 in horizontal direction in an approximately arcuate profile.

As shown in FIG. 2, the movable shade 32 is arranged so that its top end edge passes through the rear focus F of the projection lens 28 when it is in the light shielding position. This shields part of reflected light from the reflection surface 24*a* of the reflector 24 to remove most of the upward light irradiated forward from the projection lens 28. When the movable shade 32 moves from the light shielding position to the light shielding alleviating position, its top end edge 32 is displaced obliquely downward in rear direction to reduce the shielding volume of the light from the reflection surface 24*a*. In this embodiment, the shielding volume of the light from the reflection surface 24*a* is approximately zero in the light shielding alleviating position.

The actuator 36 is configured by a solenoid having a plunger 36*a* extending in longitudinal direction and is fixed to a mounting section 24*a* formed on the bottom surface of the bottom wall 24*c* of the reflector 24. The plunger 36*a* of the actuator 36 is engaged, at its tip, with a stay 32*b* formed to protrude downward from the movable shade 32. This transmits the longitudinal reciprocating motion of the plunger 36*a* as the rotational motion of the movable shade 32. When a beam selector switch (not shown) is operated, the actuator drives the movable shade 32*a* to longitudinally move the plunger 36*a*, thereby moving the movable shade 32 between the light shielding position and the light shielding alleviating position.

In front of the movable shade 32 is formed a stationary shade 40 integrated with the holder 26 for preventing stray light reflected onto the reflector 24 from impinging on the projection lens 28. On the stationary shade 40 are formed a positioning contact section 40*a* for coming in contact with the movable shade 32 to fix it in the light shielding position when the movable shade 32 has moved to the light shielding position and a positioning contact section 40*b* for coming in contact with the movable shade 32 to fix it in the light shielding alleviating position when the movable shade 32 has moved to the light shielding alleviating position.

Figure 5:
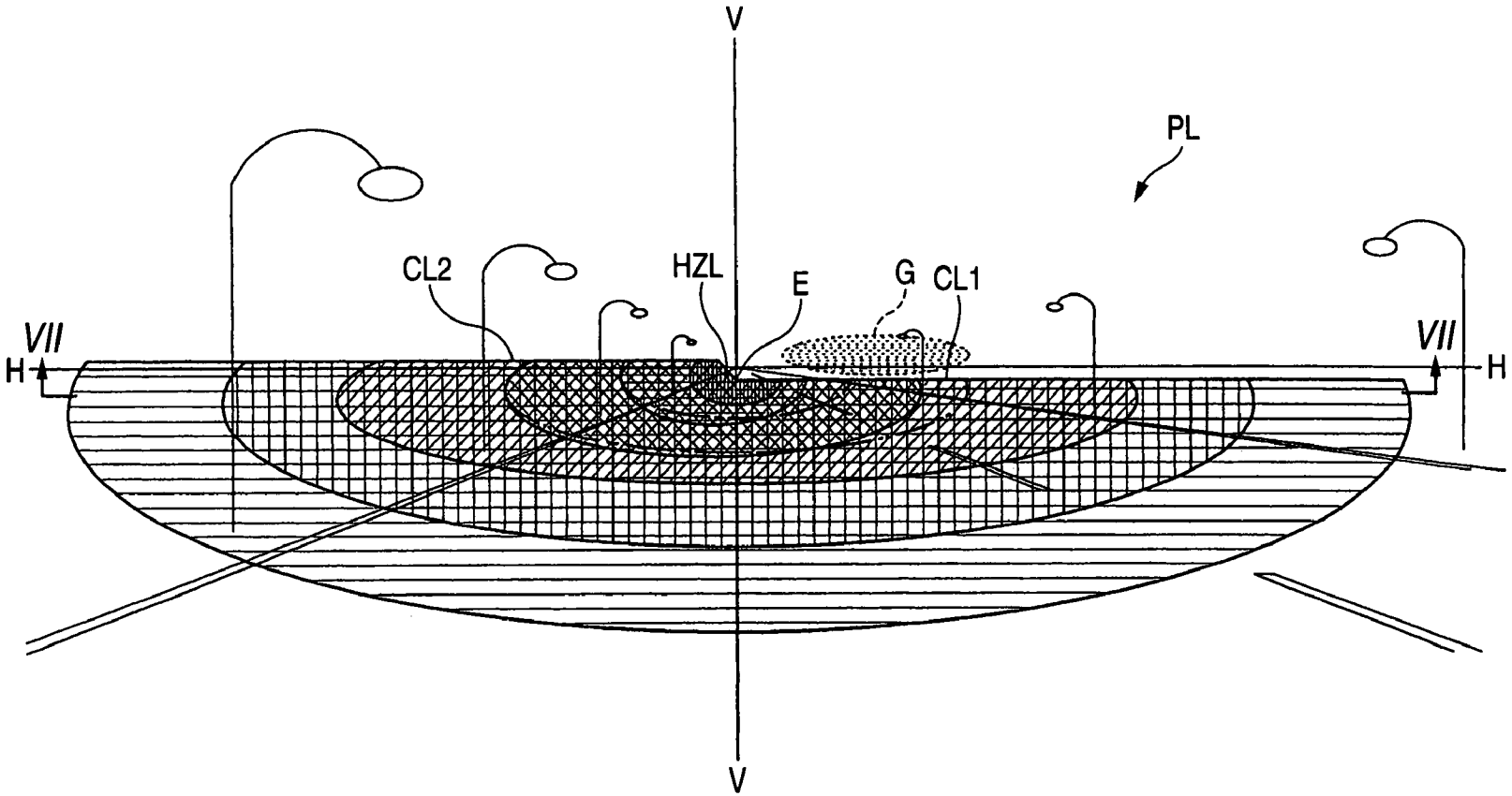
FIG. 5 is a perspective view of a low beam light distribution pattern formed on a virtual vertical screen arrange data position 25 meters ahead of the lighting fixture unit by the light irradiated forward from the vehicle headlamp.
Figure 6:
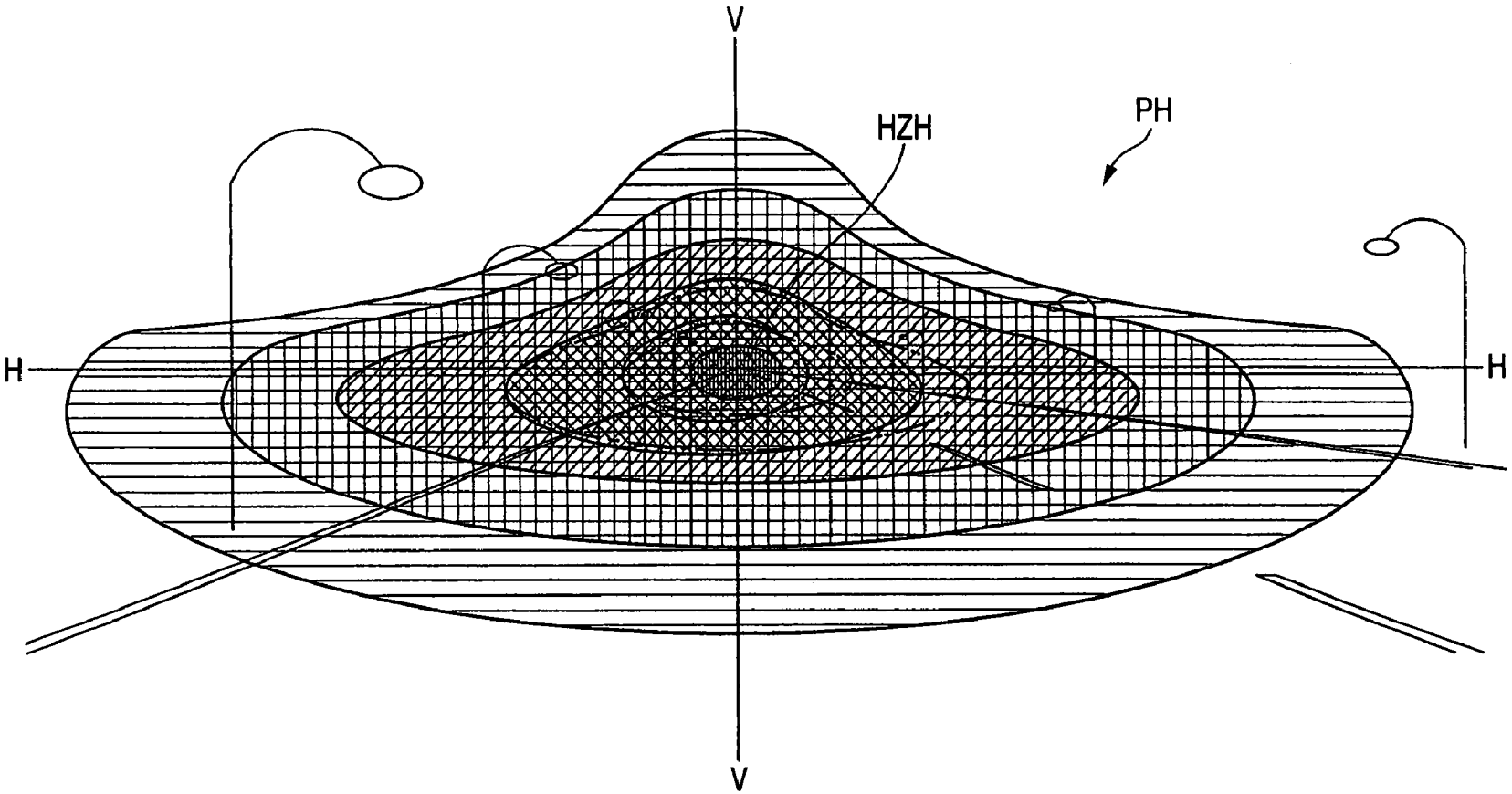
FIG. 6 is a perspective view of a high beam light distribution pattern formed on the virtual vertical screen by the light irradiated forward from the vehicle headlamp.

FIGS. 5 and 6 are perspective views of a light distribution pattern formed on a virtual vertical screen arranged at a position 25 meters ahead of the lighting fixture unit by the light irradiated forward from the vehicle headlamp 10. FIG. 5 shows a low beam light distribution pattern PL and FIG. 6 shows a high beam light distribution pattern PH.

The low beam light distribution pattern PL is one formed when the movable shade 32 is in the light shielding position. The high beam light distribution pattern PH is one formed when the movable shade 32 is in the light shielding alleviating position. A plurality of curves formed so as to be substantially concentrically circular with the curves showing the contour of the low beam light distribution pattern or high beam light distribution pattern are equiintensity curves showing that the light distribution pattern becomes gradually brighter from its peripheral edge to center.

The low beam light distribution pattern PL shown in FIG. 5 is a left side light distribution pattern that has cutoff lines CL1, CL2 with a stepped difference at top end edge. The cutoff lines CL1, CL2 extends, with a stepped difference, in horizontal direction, about a V-V line passing through H-V as a vanishing point in the front direction of the lighting fixture unit. The oncoming lane side section on the right side of the V-V line is formed as the lower horizontal cutoff line CL1, while the own lane side section on the left side of the V-V line is formed as the upper horizontal cutoff line CL2 stepped up via a tilted section from the lower horizontal cutoff line CL1.

In the low beam light distribution pattern PL, the position of an elbow point E as the intersection of the lower horizontal cutoff line CL1 and the V-V line is positioned some 0.5 to 0.6 degrees below H-V. This is because the optical axis Ax of the lighting fixture unit 20 extends some 0.5 to 0.6 degrees downward with respect to the longitudinal direction of the vehicle. In the low beam light distribution pattern PL, a hot zone HZL as a high intensity area is formed to surround the elbow point E.

The low beam light distribution pattern PL is formed by projecting, as an inverted projection image, by way of reflected light from the reflection surface 24*a* of the reflector 24, the image of the light source 22*a* formed on the rear focal plane of the projection lens 22 onto the virtual vertical screen. The cutoff lines CL1, CL2 are formed as inverted projection images of the top end edge 32*a* of the movable shade 32.

Figure 4:
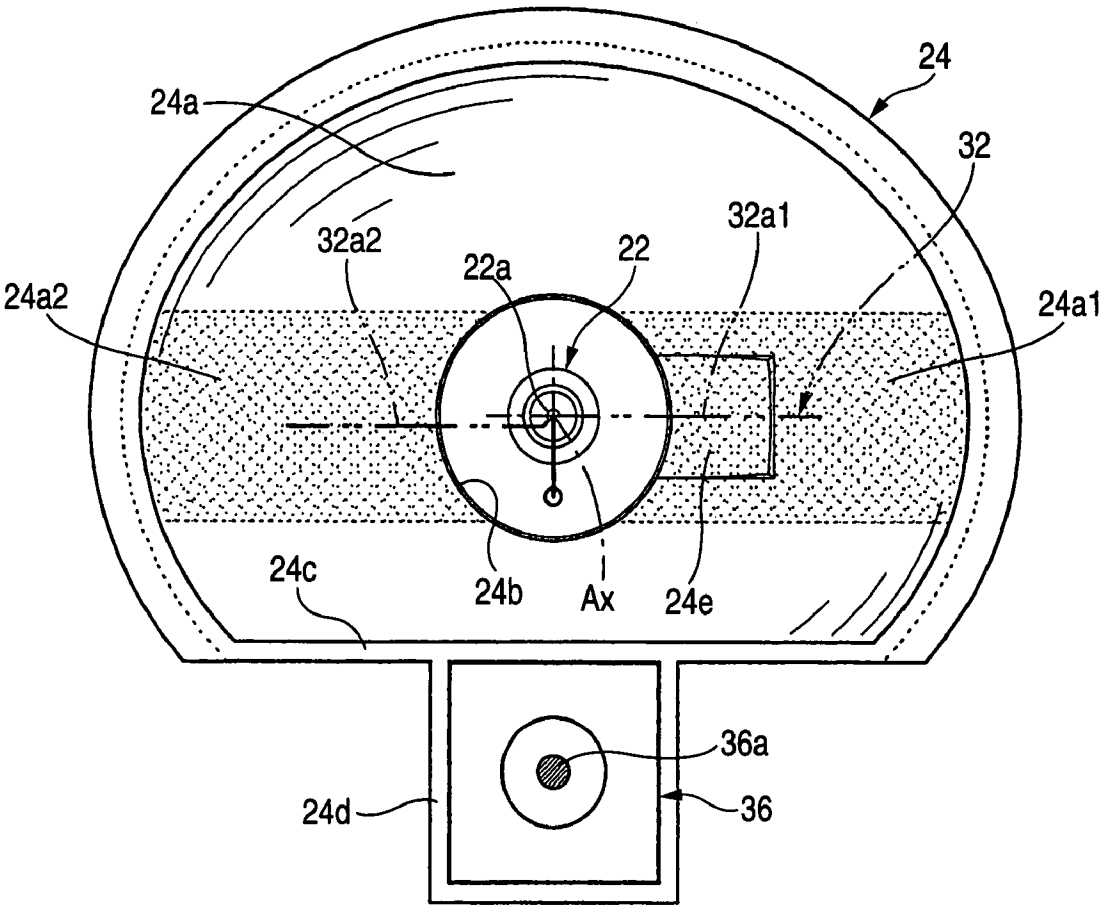
FIG. 4 is a front view of the reflector of the lighting fixture unit with a light source bulb and an actuator attached.

FIG. 4 is a front view of the reflector 24 of the lighting fixture unit 20 with the light source bulb 22 and the actuator 36 attached.

As shown in FIG. 4, the lower horizontal cutoff line CL1 is formed as the inverted projection image of the upper horizontal section 32*a*1 positioned to the left of the optical axis Ax at the upper end edge 32*a* of the movable shade 32. To its formation contributes reflected light from a strip reflection area 24*a*1 positioned to the left of the optical axis Ax on the reflection surface 24*a* of the reflector 24. The upper horizontal cutoff line CL2 is formed as the inverted projection image of the lower horizontal section 32*a*2 positioned to the right of the optical axis Ax at the upper end edge 32*a* of the movable shade 32. To its formation contributes reflected light from a strip reflection area 24*a*2 positioned to the right of the optical axis Ax on the reflection surface 24*a* of the reflector 24.

The reflection area 24*a*1 positioned to the left of the optical axis Ax is configured as the light-gathering reflection surface 24*e* (the second reflection surface 24*e*) that reflects light from the light source 22*a* toward the vicinity of the rear focus F of the projection lens 28. For this configuration, the light-gathering reflection surface 24*e* is configured by a spheroidal surface (an ellipsoid of revolution) having a center axis (a rotational axis) on the optical axis Ax. The first focus of the elliptical surface is set at the center of the light source 22*a* on the optical axis Ax and its second focus is set at the rear focus F of the projection lens 28. The light-gathering reflection surface 24*e* is set as a substantially rectangular reflection area facing the opening 24*b*.

By the light-gathering reflection surface 24*e*, a part of reflected light that would contribute to formation of the lower horizontal cutoff line CL1 assumed in case the light-gathering reflection surface 24*e* were not formed (light having an optical path indicated by chain double-dashed lines shown in FIG. 3) is reflected toward the vicinity of the rear focus F of the projection lens 28 and is emitted from the projection lens 28 as light substantially parallel to an optical axis Ax.

In FIG. 5, an area G positioned relatively near the V-V line in the vicinity of the top of the lower horizontal cutoff line CL1 is an eye point area where the eye-point of the driver of an oncoming car is often positioned. The equiintensity curves indicated by a chain double-dashed line in FIG. 5 are those assumed in case the light-gathering reflection surface 24*e* were not formed. In reality, the light-gathering reflection surface 24*e* is formed. Thus, as indicated by solid lines in FIG. 5, the portion positioned in the vicinity of the bottom of the lower horizontal cutoff line CL1 with respect to the equiintensity curve indicated by the chain double-dashed line is dislocated near the V-V line.

In this way, the irradiation amount to the portion positioned in the vicinity of the area below the eye point area G relatively close to the V-V line among the portions located in the vicinity of and below the lower horizontal cutoff line CL2 in the low beam light distribution pattern PL is reduced. Thus, there is no fear of glare to the drivers of oncoming vehicles even when the vehicle pitches while traveling under low-beam illumination conditions.

The high beam light distribution pattern PH shown in FIG. 6 is formed to expand to some extent from its cutoff lines CL1, CL2 with respect to the low beam light distribution pattern PL and has a hot zone HZH in the vicinity of H-V. The hot zone HZH has a center located slightly below H-V. This is due to the fact that the optical axis Ax of the lighting fixture unit 20 extends some 0.5 to 0.6 degrees downward with respect to the longitudinal direction of the vehicle.

The equiintensity curves indicated by a chain double-dashed line in FIG. 6 are those one assumed in case the light-gathering reflection surface 24*e* were not formed. In reality, the light-gathering reflection surface 24*e* is formed. Thus, as indicated by solid lines in FIG. 5, the portion enclosed by solid lines are reduced somewhat leftward with respect to the equiintensity curves indicated by chain double-dashed lines, and in return for this, the center intensity of near H-V is enhanced. This improves the long distance visibility under high-beam illumination conditions.

Figure 7:
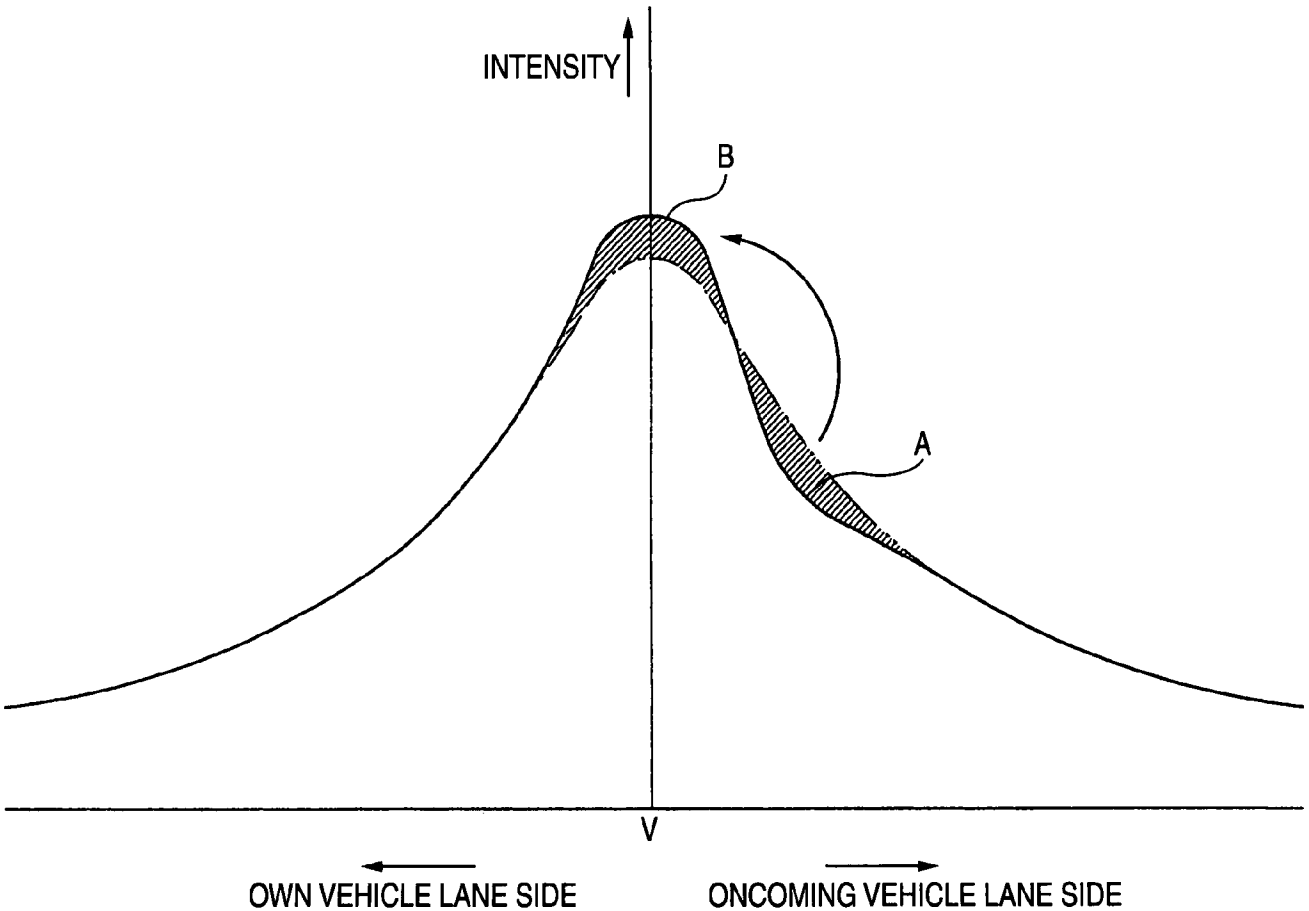
FIG. 7 shows the horizontal intensity distribution of the low beam light distribution pattern on the VII-VII cross section in FIG. 5.

FIG. 7 shows the horizontal intensity distribution of the low beam light distribution pattern PL on the VII-YII cross section (horizontal cross section in the vicinity of the area below the low horizontal cutoff line CL1).

As shown by solid lines in FIG. 7, the low beam light distribution pattern PL has a horizontal intensity distribution that is brightest near the V-V line and gradually darkens toward leftward and rightward. The horizontal intensity distribution indicated by chain double-dashed lines is one assumed in case the light-gathering reflection surface 24*e* were not formed. In reality, the light-gathering reflection surface 24*e* is formed. Thus, the horizontal intensity distribution of the low beam light distribution pattern PL has a portion A near the V-V line in its oncoming lane side section that is darker than the horizontal intensity distribution indicated by chain double-dashed lines, and in return for this, has a portion B in the vicinity of the V-V line that is brighter than the horizontal intensity distribution indicated by chain double-dashed lines.

As detailed above, the lighting fixture unit 20 of the vehicle headlamp 10 according to the embodiment of the invention is a projector-type lighting fixture unit equipped with a movable shade 32 and is designed to form, when the movable shade 32 is in the light shielding position, the low beam light distribution pattern PL having cutoff lines CL1, CL2 where the oncoming lane side section to the right of H-V is formed as a lower horizontal cutoff line CL. In this practice, the reflection area 24*a*1 of the reflection surface 24*a* of the reflector 24 contributing to formation of the lower horizontal cutoff line CL1 is partially configured as the light-gathering reflection surface 24*e* reflecting light from the light source 22*a* toward the vicinity of the rear focus F of the projection lens 28. This provides the following operation/working-effect.

The light from the light source reflected onto the light-gathering reflection surface 24*e* goes toward the vicinity of the rear focus F of the projection lens 28, so that the light is emitted from the projection lens 28 as light substantially parallel to the optical axis Ax in the front direction of a lighting fixture. This reduces the irradiation amount on the vicinity of the lower horizontal cutoff line CL1 in the oncoming lane side section in the low beam light distribution pattern PL. Thus, there is no fear of glare to the drivers of oncoming vehicles even when the vehicle pitches while traveling under low-beam illumination conditions. Moreover, it is possible to enhance the center intensity in the front direction of the lighting fixture unit in the high beam light distribution pattern.

According to the embodiment, with the projector-type vehicle headlamp 10 equipped with a movable shade 32, it is possible to prevent glare to the drivers of oncoming vehicles even when the vehicle pitches while traveling under low-beam illumination conditions, as well as improving the long distance visibility under high-beam illumination conditions.

The lighting fixture unit 20 according to the embodiment has an opening 24*b* for inserting the light source bulb 22 formed at the rear top of the reflector 24. The light-gathering reflection surface 24*e* is formed in the vicinity of the opening 24*b*. This provides the following operation/working-effect.

The region in the vicinity of the opening 24*b* among the reflection areas 124*a*1 contributing to formation of the lower horizontal cutoff line CL1 is suitable for forming the portion near the V-V line in the lower horizontal cutoff line CL1. The area above and close to the portion is the eye point area G of the driver of an oncoming vehicle. Thus, the reflected light from the region in the vicinity of the opening 24*b* is a main cause of glare to the drivers of oncoming vehicles caused by pitching of the vehicle. In the embodiment, the region in the vicinity of the opening 24*b* is the light-gathering reflection surface 24*e*, which more effectively suppresses glare to the drivers of oncoming vehicles.

While the light-gathering reflection surface 24*e* is a single rectangular reflection area facing the opening 24*b* in the embodiment, a reflection area of any other form (such as an ellipse) or a plurality of reflection areas may be used in another embodiment, as long as they are positioned in the vicinity of the opening 24*b*.

While the hot zone HZH of the high beam light distribution pattern PH has a center located slightly below H-V in the embodiment, it is possible to set the second focus of the spheroidal surface constituting the light-gathering reflection surface 24*e* slightly below the rear focus F of the projection lens 28 to position the center of the hot zone HZH at H-V, in another embodiment. This further improves the long distance visibility under high-beam illumination conditions.

While the own vehicle lane side section in the cutoff line CL1, CL2 of the low beam light distribution pattern PL configured by the lighting fixture unit 20 is constituted by an upper cutoff line CL2 in the embodiment, the same operation/working-effect as the above embodiment is provided even in case the own vehicle lane side section is configured as an oblique cutoff line rising at a predetermined angle from the lower horizontal cutoff line CL to the own vehicle lane side section.

While the left side low beam light distribution pattern is formed as a low beam light distribution pattern PL formed by the lighting fixture unit 20 in the embodiment, a right left side low beam light distribution pattern may be formed to employ the same configuration as the above embodiment thus providing the same operation/working-effect.

A variation of the embodiment will be described.

Figure 8:
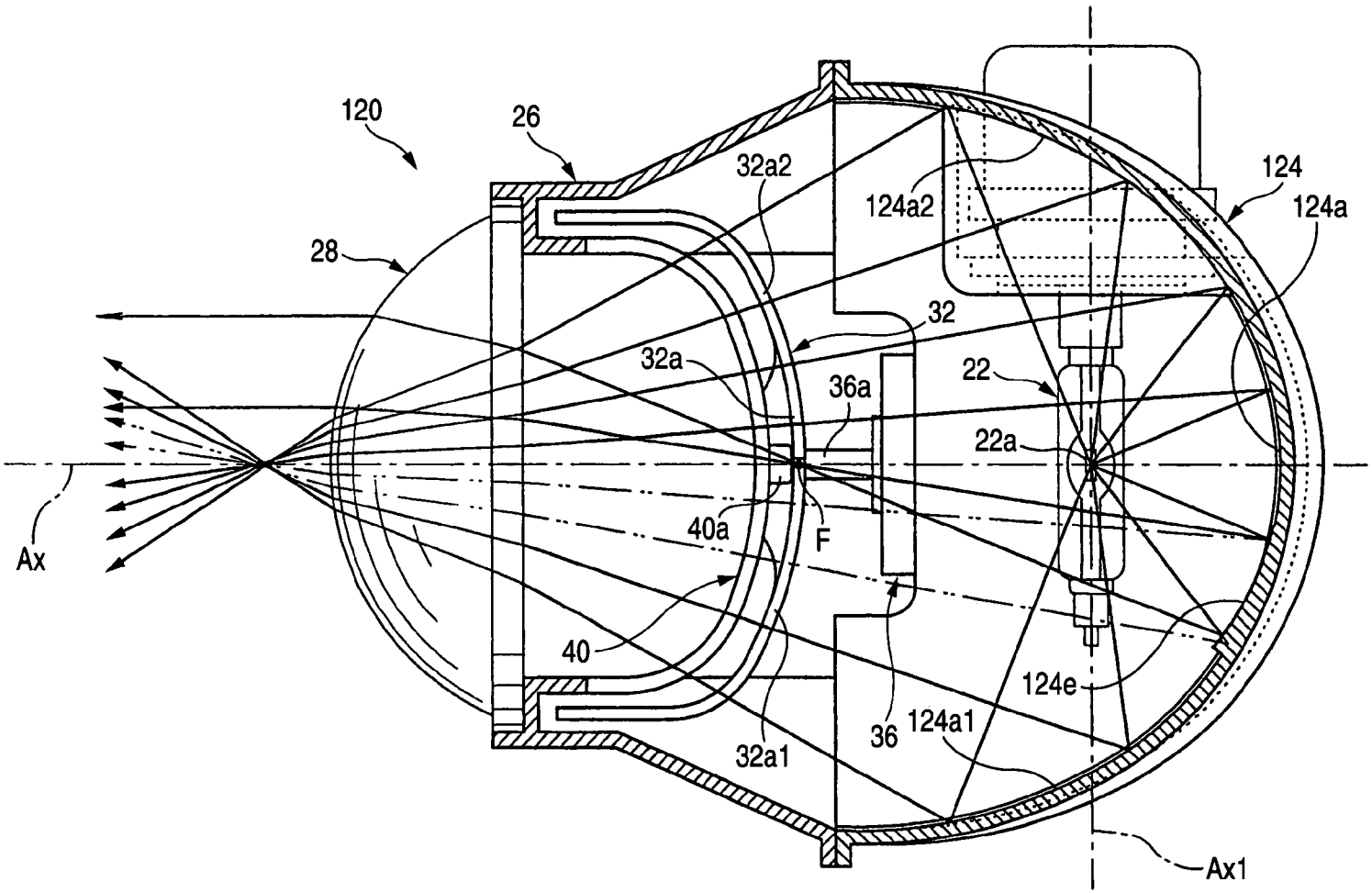
FIG. 8 is a horizontal cross section showing the lighting fixture unit according to the variation of the embodiment.

FIG. 8 is a horizontal cross section showing the lighting fixture unit 120 according to the variation of the embodiment.

As shown in FIG. 8, the lighting fixture unit 120 is the same as the lighting fixture unit except that the arrangement of the light source bulb 22 and profile of the reflector 124 are different.

The light bulb 22 of the lighting fixture unit 120 is inserted and fixed from behind the side of the optical axis Ax to the reflector 24, at a position behind the rear focus F of the projection lens 28 and below the optical axis Ax. This insertion/setting is made so as to position the emission center of the light source 22*a* vertically below the optical axis Ax in a state where the center axis Ax1 of the bulb is set to extend in horizontal direction in a vertical plane orthogonal to the optical axis Ax.

While the profile of the reflector 124 of the lighting fixture unit is different from that of the reflector 24 in the above embodiment, the reflector 124 has a reflection surface 124*a* that reflects light from the light source 22*a* in forward direction toward an area close to the optical axis Ax. The reflection surface 124*a* is designed so that its substantially elliptical cross section including the optical axis Ax has a first focus as the emission center position of the light source 22*a* and its eccentricity gradually increases from the vertical cross section to the horizontal cross section. Thus, the light from the light source 22*a* reflected onto the reflection surface 124*a* is substantially converged in the vicinity of the rear focus F in the vertical cross section while the convergence position of the light is shifted substantially forward in the horizontal cross section.

For the reflector 124, reflected light from the strip reflection area 124*a*1 positioned to the left of the optical axis Ax contributes to formation of the lower horizontal cutoff line CL1, while reflected light from the strip reflection area 124*a*2 positioned to the right of the optical axis Ax contributes to formation of the upper horizontal cutoff line CL1. The region in the vicinity of the optical axis Ax in the left reflection area 124*a*1 is configured as the light-gathering reflection surface 124*e* reflecting light from the light source 22*a* toward the vicinity of the rear focus F of the projection lens 28.

By using the light-gathering reflection surface 124*e*, part of reflected light that would contribute to formation of the lower horizontal cutoff line CL1 assumed in case the light-gathering reflection surface 124*e* were not formed (light having an optical path indicated by chain double-dashed lines shown in FIG. 8) is reflected toward the vicinity of the rear focus F of the projection lens 28 and is emitted from the projection lens 28 as light substantially parallel to the optical axis Ax.

Use of this variation provides the same operation/working-effect as the above embodiment.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

a projection lens arranged on an optical axis extending in a longitudinal direction of a vehicle;

a light source arranged behind a rear focus of the projection lens;

a reflector for reflecting light from the light source in a forward direction toward a position on the optical axis forward with respect to the vicinity of the rear focus of the projection lens;

a movable shade movable to shield part of the reflected light from the reflector;

an actuator that moves the movable shade between a light shielding position and a light shielding alleviating position, wherein a low beam light distribution pattern having a horizontal cutoff line is formed when the movable shade is in the light shielding position, and a high beam light distribution pattern is formed when the movable shade is in the light shielding alleviating position; and a light-gathering reflection surface for reflecting light from the light source toward the vicinity of the rear focus of the projection lens provided on a part of a reflection area of the reflector contributing to the formation of the horizontal cutoff line, wherein the light-gathering reflection surface is only arranged on one of a first side and second side of the optical axis, wherein the first side contributes to the low beam light distribution pattern provided below an upper part of the horizontal cutoff line and the second side contributes to the low beam light distribution pattern provided below a lower part of the horizontal cutoff line.

2. The vehicle headlamp according to claim 1, when the movable shade is in the light shielding position a top end edge of the shade is positioned near the optical axis in a vicinity of the rear focus of a projection lens, and when the movable shade is in the light shielding alleviating position, a shading amount for reflected light from a reflector is reduced than the light shielding position.

3. The vehicle headlamp according to claim 1, wherein the horizontal cutoff line is formed on an oncoming lane side section in the low beam light distribution pattern.

4. The vehicle headlamp according to claim 1, wherein the light-gathering reflection surface is formed in a vicinity of a rear top of the reflector.

5. The vehicle headlamp according to claim 1, further comprising an opening formed at a rear top of the reflector, wherein the light-gathering reflection surface is formed in the vicinity of the opening.

* * * * *